US010967895B2

(12) United States Patent
Bauer et al.

(10) Patent No.: US 10,967,895 B2
(45) Date of Patent: Apr. 6, 2021

(54) METHOD FOR SAFE SUPERVISION OF TRAIN INTEGRITY AND USE OF ON-BOARD UNITS OF AN AUTOMATIC TRAIN PROTECTION SYSTEM FOR SUPERVISION TRAIN INTEGRITY

(71) Applicant: Thales Management & Services Deutschland GmbH, Ditzingen (DE)

(72) Inventors: Harald Bauer, Backnang (DE); Veit Lauterberg, Neuhausen (DE); Christian Wallner, Weil der Stadt (DE); Klaus Mindel, Affalterbach (DE)

(73) Assignee: THALES MANAGEMENT & SERVICES DEUTSCHLAND GMBH, Ditzingen (DE)

( * ) Notice: Subject to any disclaimer, the term of this patent is extended or adjusted under 35 U.S.C. 154(b) by 119 days.

(21) Appl. No.: 16/150,573

(22) Filed: Oct. 3, 2018

(65) Prior Publication Data

US 2019/0031220 A1 Jan. 31, 2019

Related U.S. Application Data

(63) Continuation of application No. PCT/EP2017/057918, filed on Apr. 4, 2017.

(30) Foreign Application Priority Data

Apr. 4, 2016 (EP) ..... 16163692

(51) Int. Cl.
*B61L 27/00* (2006.01)
*B61L 25/02* (2006.01)
(Continued)

(52) U.S. Cl.
CPC ..... *B61L 27/0094* (2013.01); *B61L 15/0027* (2013.01); *B61L 15/0054* (2013.01);
(Continued)

(58) Field of Classification Search
CPC ..... B61L 27/0094; B61L 15/0027; B61L 15/0054; B61L 23/34; B61L 25/025
See application file for complete search history.

(56) References Cited

U.S. PATENT DOCUMENTS 6,081,769 A * 6/2000 Curtis ..... B61L 1/14 246/122 R
6,311,109 B1 * 10/2001 Hawthorne ..... B61L 3/002 246/122 R (Continued)

FOREIGN PATENT DOCUMENTS

AU 2006 202 620 A1 1/2007
DE 10 2004 057 545 A1 6/2006

(Continued)

*Primary Examiner* — Hussein Elchanti
(74) *Attorney, Agent, or Firm* — Hackler Daghighian Martino & Novak

(57) ABSTRACT

A method for safe supervising train integrity includes: (a) acquiring first position data of the first carriage via a first tracking unit which is installed on-board of a first carriage and acquiring second position data of a second carriage via a second tracking unit which is installed on-board of the second carriage, wherein the position data is related to a rail route coordinate system; (b) determining a deviation between a reference value which depends on the length of the train and a position value which depends on position data of at least one of the tracking units; (c) detecting whether train integrity is given by analyzing the deviation; (d) repeating steps a) through c); wherein the tracking units are part of on-board units of an automatic train protection system. Thus a cost-efficient method for supervising train integrity which complies with safety level SIL4 can be realized.

9 Claims, 3 Drawing Sheets

(51) Int. Cl.
*B61L 15/00* (2006.01)
*B61L 23/34* (2006.01)

(52) U.S. Cl.
CPC ..... *B61L 23/34* (2013.01); *B61L 25/025* (2013.01); *B61L 25/021* (2013.01); *B61L 25/023* (2013.01); *B61L 2027/0044* (2013.01)

(56) References Cited

U.S. PATENT DOCUMENTS 7,317,987 B2 * 1/2008 Nahla ..... B61L 25/025 701/301
2006/0290478 A1 * 12/2006 Stull ..... B61L 15/0027 340/425.5
2007/0084972 A1 * 4/2007 Riley ..... B61L 15/0054 246/77
2008/0243320 A1 * 10/2008 Otsubo ..... B61L 15/0072 701/19
2009/0222776 A1 * 9/2009 Meers ..... G06F 30/39 716/106
2011/0238241 A1 * 9/2011 Brady ..... B61L 25/048 701/19
2012/0303188 A1 * 11/2012 Braband ..... B61L 15/0054 701/19
2012/0323411 A1 * 12/2012 Whitwam ..... B61L 11/08 701/19
2013/0248658 A1 * 9/2013 Takagi ..... G01S 19/50 246/122 R
2016/0046308 A1 * 2/2016 Chung ..... B61L 25/021 701/20
2016/0121912 A1 * 5/2016 Puttagunta ..... B61L 27/04 701/19
2016/0200327 A1 * 7/2016 Liu ..... B61L 25/02 105/8.1
2019/0100226 A1 * 4/2019 Baier ..... B61L 15/0063

FOREIGN PATENT DOCUMENTS

DE 10 2006 005 207 A1 8/2007
DE 10 2006 062 559 A1 7/2008
EP 0 761 522 A1 3/1997
EP 1 661 784 A1 5/2006
EP 2 531 391 A1 12/2012
EP 2 684 760 A2 1/2014
ZA 2000 056 12 B 5/2001
ZA 2004 037 05 B 7/2005

* cited by examiner

METHOD FOR SAFE SUPERVISION OF TRAIN INTEGRITY AND USE OF ON-BOARD UNITS OF AN AUTOMATIC TRAIN PROTECTION SYSTEM FOR SUPERVISION TRAIN INTEGRITY

CROSS-REFERENCE TO RELATED APPLICATIONS

This continuation application claims priority to PCT/EP2017/057918 filed on Apr. 4, 2017 which has published as WO 2017/174541 A1 and also the European application number EP16163692.3 filed on Apr. 4, 2016, the entire contents of which are fully incorporated herein with these references.

DESCRIPTION

Field of the Invention

The invention concerns a method for supervision of the integrity of a train and the use of on-board units of an automatic train protection system for supervision of train integrity.

Background of the Invention

A method for supervision of train integrity is disclosed in EP 2 531 391 B1 and ZA 2004 037 05.

One important aspect of safe railway operation is to avoid collisions between trains which often happen due to lost carriages.

A common solution is the detection of track vacancy. Entering a section already occupied by another train will be prohibited in this way. Traditionally this track vacancy detection is done via track side equipment such as track circuits and axle counters. Yet, in order to grant operability this track side equipment needs extensive maintenance.

An alternative solution is implicit track free detection by a continuously monitoring of train front or rear position and train integrity. This solution is already specified in the ETCS level 3 (specified by the UNISIG standard).

ZA 2000 056 12 discloses means for detecting loss of rain integrity comprising axle rotation-time interval counters at the front and back ends of a train. The count at the back are transmitted to the front where the count are compared and a discrepancy above a predetermined limit gives rise to an alarm signal and/or other desired or required reaction. Yet, the direction of rotation is not considered with the described method. Further, errors of the single sensors are cumulated, e.g. due to discrepancy of wheel diameters)

EP 2 531 391 B1 discloses a method for monitoring train integrity, wherein position data is acquired by means of a plurality of train integrity modules (TIM) which are positioned within carriages of the train. A digital map is provided indicating the position of shunting areas, wherein the TIMs exchange data during a calibration phase by means of near field communication while leaving the shunting area. Sensor data (speed, position, moving direction) are exchanged between the train integrity modules until the respective carriages reach a second shunting area. The data is transmitted to a control center. The sensor data of different TIMs are acquired via GNSS and are compared with each other. In case the data of different TIMs comply with each other the TIMs are supposed to be located at the same train. The TIMs have to be installed permanently at the carriages which makes the known method expensive.

ZA 2004 037 05 discloses a method for reporting train integrity by use of GPS devices located in a front unit and in a back unit of a train. The GPS units report speed simultaneously and with the use of telemetry equipment the speed measurements are brought together and are compared for discrepancy.

A disadvantage of the GPS-based methods disclosed in EP 2 531 391 B1 and ZA 2004 037 05 is that poor satellite reception due to insufficient satellite coverage or tunnels impair the availability.

None of the known methods for controlling train integrity can be ensure safety at the required SIL4-level.

It is therefore an object of the invention to suggest a cost-efficient method for supervising train integrity which complies with safety level SIL4.

This object is solved by a method according to claim 1.

SUMMARY OF THE INVENTION

According to the invention a method for safe supervision of the integrity of a train is suggested, in particular at SIL4-level, wherein the train comprising a first carriage and a second carriage. The inventive method comprises:

a. acquiring first position data of the first carriage via a first tracking unit which is installed on-board of the first carriage and acquiring second position data of the second carriage via a second tracking unit which is installed on-board of the second carriage, wherein the position data is related to a rail route coordinate system;

b. determining a deviation Δ between a reference value which depends on the length L of the train and a position value which depends on position data of at least one of the tracking units;

c. detecting whether train integrity is given by analyzing the deviation;

d. Repeating steps a) through c).

According to the invention SIL4-proved tracking units are used. The tracking units use the same coordinate system for position determination.

The inventive method uses a safe system for position determination, which allows monitoring of the length of a train with SIL4 and ensuring reliably that the train was not split or additional carriages were coupled, by using existing on-board equipment. Thus information concerning the completeness of the train (train integrity) can be achieved without the need to provide additional train integrity equipment such as sensors and power supply.

The position data are rail route coordinate system related, i.e. "position" is a point within the rail route coordinate system. A point in this coordinate system (position) is expressed by a distance along the rail route to a reference point (well-defined point on a rail route with a known and measurable relation to a prominent stationary point (reference point), e.g. signal location, switch location, danger point location, platform end location). Position and sequence of the reference points have to be known.

In a preferred variant the position data is determined via distance measurement along a rail route coordinate system (continuous counting of kilometers along a track) with reference to at least one reference point. According to the invention absolute localization of railway vehicles in a rail route coordinate system is used. Two tracking units are used, wherein the tracking units take into consideration the rail route coordinate system (one-dimensional coordinate system along the rail route) of the train.

The position value may be the distance between the first tracking unit and the second tracking unit which can be determined by subtraction of the first and the second (rail route coordinate system related) position data. The reference point is supposed to be the origin of ordinates of the rail route coordinate system and may be implemented in a machine readable manner (e.g. in form of an Eurobalise) in order to support train borne positioning systems. For position determination the direction of passing the reference point as well as is considered. Thus for determination of the position data a reference point, the distance of the tracking units to the reference point and the moving direction of the train should be known. Instead of using distance measurement along a rail route coordinate system during detection of the position data it is also possible to convert preliminary (not rail route coordinate system related) position data (e.g. position data received via GNSS or Camera based systems using track specific patterns), into position data of the respective rail route coordinate system subsequent to acquisition of position data, e.g. by means of a map containing the track routing.

A multitude of reference points can be used within one rail route, wherein an actual reference point is used for determining the position data. Preferably the reference point that has been passed most recently is used as actual reference point. Near each branch point of the track a reference point is recommended. The last reference point of the first tracking unit may serve as actual reference point for the second tracking unit.

In a highly preferably variant balises are used as reference points.

Preferably, after passing a reference point a new coordinate system is used for position data acquisition.

In a highly preferred variant of the inventive method the tracking units are part of on-board units of an automatic train protection system, e.g. an ETCS-system, a PTC-system or a LZB-system. The on-board units are on-board computing systems, which perform important tasks of an automatic train protection (ATP)-system and contain SIL4-approved components. Hence the inventive method uses a safe system (e.g. OBU of an ETCS-system) for position determination.

In a special variant of the afore mentioned method the first and second position data is transmitted to a control center of the automatic train protection system, in particular to a radio block center of an ETCS-system, wherein the analyzing of the deviation is carried out by means of a central processing unit of the control center. Thus an existing connection for data transmission between on-board units and control center, e.g. via GSM-R, can be used. Analyzing of the deviation can comprise determination of the distance and the comparison of the determined distance with the reference value.

In an alternative variant the position data of the first carriage is transmitted to the second carriage wherein the determination of the distance and the analyzing of the deviation is carried out by means of an on-board unit of the second carriage and/or that the position data of the second carriage is transmitted to the first carriage, wherein the analyzing of the deviation is carried out by means of the on-board unit of the first carriage. Here the train integrity is controlled by means of the train itself (train based integrity supervision). The tracking unit to which the position data of the other tracking unit is transmitted acts as a "supervising unit", whereas the other tracking unit acts as "slave unit". For this variant no communication with a control center is required. Yet, a safe connection for data transmission between the on-board units is required. Preferably the data transmission is carried out wireless. But also transmission via a wired connection is possible.

Generally the train comprises more than two carriages, wherein further carriages are located between the first and the second carriage. It is preferred that the first carriage is the front carriage, in particular a locomotive, and the second carriage is the rear carriage, in particular a locomotive, of the train. Generally the tracking units are installed within the carriage at a fixed offset to the front end and the rear end of the train respectively. Preferably during acquisition of the position data said offsets are considered, thus that the determined distance complies with the train length.

In a preferred variant an alert is initiated in case analyzing of the deviation result is a loss of train integrity. Also an emergency stop can be initiated.

Most preferably movement authority is denied in case analyzing of the deviation result is a loss of train integrity.

Since during acceleration and deceleration the distance between neighboring carriages of the train may vary slightly ("train length oscillation"), an alert is preferably initiated not until the deviation exceeds a predetermined value, in particular 1% of the reference value. Thus, initiating an alert/emergency stop and/or denying movement authority due to "train length oscillation" can be avoided.

In a special variant the reference value is the position value previously determined by having carried out steps a)-c).

The invention also concerns a usage of on-board units of an automatic train protection system for supervision of train integrity, wherein a first on-board unit is installed on-board of the first carriage and comprises a first tracking unit and a second on-board unit is installed on-board of the second carriage and comprises a second tracking unit.

The inventive idea is to realize the train integrity supervision by having two tracking units, one on the front side and one on the back side of the train. Thus no special train integrity equipment is necessary. The principle is based on using already existing or otherwise used safe localization service of the two tracking units in order to supervise train integrity. The inventive method can advantageously be used for example for freight trains with one pull and one push locomotive, for rail car trains, push-pull trains with a control car and for trains with a locomotive on the front side and a positioning tender on the rear side.

The inventive method allows safe determination of two positions (front end and rear end of a train) with defined safety integrity levels and confidence intervals by using existing on-board equipment, independent from the type of sensor data and without requiring a two-dimensional map or additional train integrity equipment. The inventive method is compatible for a wide range of existing trains, even for old carriages and freight trains.

Further advantages can be extracted from the description and the enclosed drawing. The features mentioned above and below can be used in accordance with the invention either individually or collectively in any combination. The embodiments mentioned are not to be understood as exhaustive enumeration but rather have exemplary character for the description of the invention.

BRIEF DESCRIPTIONS OF THE DRAWINGS

DETAILED DESCRIPTION OF THE PREFERRED EMBODIMENTS

Figure 1:
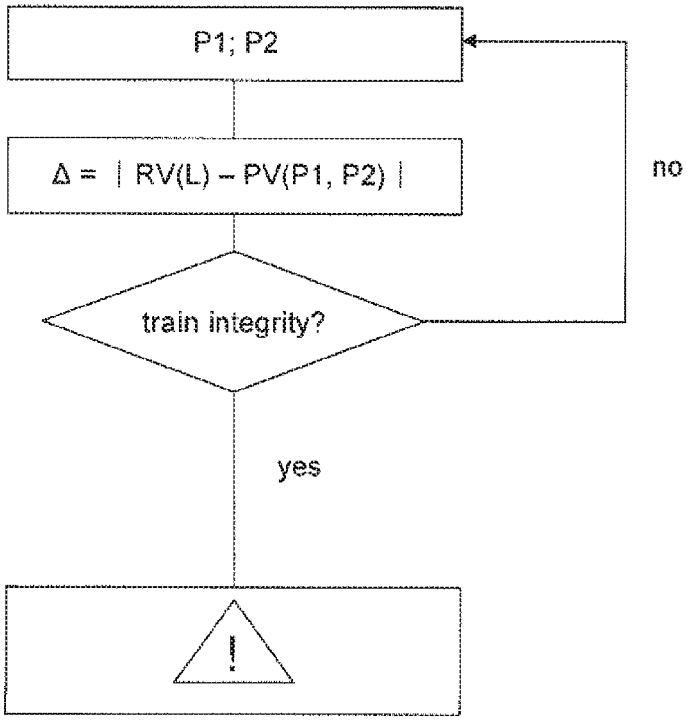
FIG. 1 shows the process of the basic method steps of the inventive method.

FIG. 1 shows the basic method steps of the inventive method. First (front end) position data P1 of a first carriage C1 of a train T and second (rear end) position data P2 of a second carriage C2 of the train T are determined via a first tracking unit T1 and a second tracking unit T2 (see FIG. 2 and FIG. 3). The tracking units T1, T2 are preferably mounted in undividable parts of train T, e.g. locomotives. Any tracking system can be used, e.g.

Doppler radar system, optical fibers, GPS, inertial sensor systems, wheel pulse transducer etc. First position data P1 (also possible: first position data P1 added to a reference value RV=RV(L), e.g. the length L of the train) and/or second position data P2 (also possible: second position data P1 added to a reference value RV, e.g. length L of the train) are transmitted to a processing unit CPU.

A deviation Δ between the reference value RV (here: length L of the train) and a position value PV=PV(P1, P2) (here: the distance D between the first position P1 and the second position P2) is calculated along a rail route of the train, e.g. by subtracting rail route coordinate system related first and second position data P1, P2 and comparing it with the length L of the train T. Instead of second position data P2 only the second tracking unit T2 may also transmit the data in which a tolerable threshold GW is included (e.g. P2+L+GW). In order to get rail route coordinate system related position data it may be necessary to convert the detected (preliminary) position data (e.g. GPS data) in order to relate the position data with a rail route coordinate system.

Analyzing the deviation Δ may comprise checking whether distance D corresponds within a reachable accuracy (±threshold GW) to the length L of the train T (in case offsets of the tracking units T1, T2 to the front/rear end of the train are considered). In case the deviation Δ of the determined distance D and the reference value L exceeds the specific threshold GW loss of integrity is detected.

Alternatively analyzing the deviation Δ may comprise checking whether the following condition is satisfied: P2+L+GW>P1>P2+L−GW.

Another possibility for analyzing the deviation Δ is that both tracking units determine third position data P3 by applying an operator which is specific for the tracking units: P3=K1(P1,L)=K2(P2,L). In case of P3=P2 this results in K1(P1,L)=P1−L and K2(P2)=P2.

It is also possible that each tracking unit P1, P2 determines expected position data of the respective other tracking unit T1, T2, and transmits the expected position data to the other tracking unit.

Figure 2:
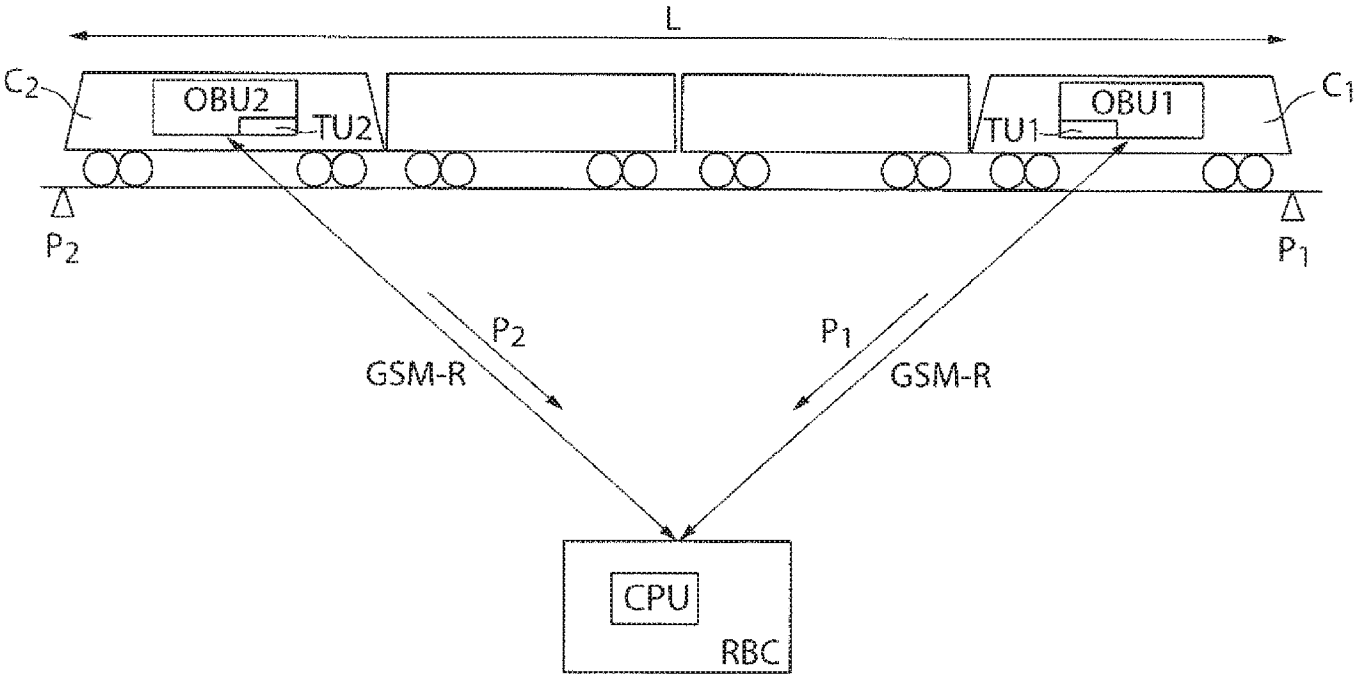
FIG. 2 shows an installation for carrying out a first variant of the inventive method, wherein train integrity is determined by an external control center.
Figure 3:
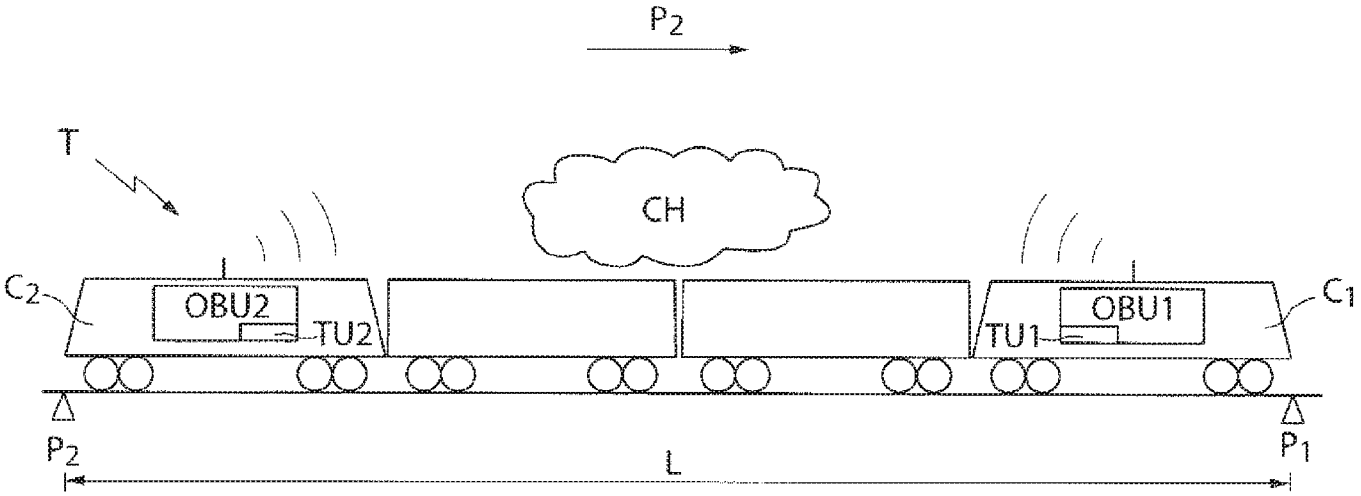
FIG. 3 shows an installation for carrying out a second variant of the inventive method with train based integrity supervision.

In FIG. 2 and FIG. 3 the required components are shown. The train T with front carriage C1 and rear carriage C2 is to be supervised with respect to train integrity. A first on-board-unit OBU1 is provided in the front carriage C1 and a second on-board-unit OBU2 is provided in the rear carriage C2, wherein the first on-board-unit OBU1 is equipped with a first tracking unit T1 and the second on-board-unit OBU2 is equipped with a second tracking unit T2. The tracking units T1, T2 do not necessarily have to be mounted on a locomotive; each kind of rolling stock that allows installation of the tracking units T1, T2 with its sensors is sufficient. A minimalistic solution could be some kind of vehicle with at least one axle and only the tracking unit T1, T2 with its sensors and the according communication system installed on it. In order to realize the inventive train integrity supervision function, a safe communication is required to transmit position data P1, P2.

Although the inventive idea is shown and described in the following based on an ETCS-system, it is not limited to the ETCS-system. In principle the inventive idea can be adapted to all kind of systems including a safe position determination (e.g. ATP-systems) that have a save positioning function implemented within its on-board unit. In the following the examples and semantics are related to the ETCS-standard. Within this standard the train integrity supervision can be realized as follows: The first on-board unit OBU1 (as shown in FIGS. 2 and 3) is in mode "FULL SUPERVISION". The second on-board unit OBU2 is in mode "SLEEPING". This guarantees that the second on-board unit OBU2 still performs the positioning function.

FIG. 2 shows a configuration in which supervision is carried out via a control center RBC. Position data P1, P2 are transmitted from the tracking units T1, T2 to a central processing unit CPU of a control center RBC via a mobile network GSM-R of the ETCS-system. According to FIG. 2 GSM-R standard is used as transport layer as this is specified in the UNISIG for the connection between RBC and OBU. Yet, the shown variant also works with other transport layers such as GPRS or UMTS. This variant requires no changes within the on-board units OBU1, OBU2, but some extensions in the control center RBC (supervision, error response). Thus it is compatible to ETCS compliant on-board units. In case of detecting a loss of integrity the control center RBC will give no movement authority any more to the first on-board unit OBU1. This will cause the first on-board unit OBU1 to change into mode "TRIP", which is a safe state.

FIG. 3 shows a configuration in which train integrity supervision is carried out on the train T directly. For this variant a separate communication channel CH between the two on-board units OBU1, OBU2 is needed. FIG. 2 shows a concept for a wireless connection. Position data P2 of the second tracking unit T2 is transmitted to the first ("FULL SUPERVISION") on-board unit OBU1 via the communication channel CH.

The protocol used for the transmission channel CH should be compliant to EN50159 for category 3 networks. As such protocols contain timeliness supervision an interruption of the communication will be disclosed in time. In case of either losing the connection between the two on-board units OBU1, OBU2 or discovering a loss of integrity as described above (Δ exceeds threshold GW) the first on-board unit OBU1 changes to mode "SYSTEM FAILURE" in order to reach a safe state. This transmission protocol and the supervision functionality are implemented within the on-board units OBU1, OBU2 and are out of scope of the existing ETCS standard.

Both variants use safe tracking units which may already be used by an automatic train protection system. Position data of the front end and the rear end of the train are determined by using distance measurement along a rail route coordinate system. In order to enhance availability and to ensure high safety level each tracking unit preferably uses a diverse measuring principle by using different types of position sensors. The inventive method enables supervision of train integrity on SIL4-level.

What is claimed is:

1. A method for safe supervising train integrity, at SIL4-level, the method comprising the steps of:

a) providing a train on a track, the train comprising a first carriage connected directly or indirectly to a second carriage, the first carriage having a first SIL4-proved tracking unit and the second carriage having a second SIL4-proved tracking unit, wherein the first carriage is located at one end of the train and the second carriage is located at the other end of the train, wherein each tracking unit is configured to wirelessly transmit a position data of its respective carriage;

b) acquiring a first position data of the first carriage via the first SIL4-proved tracking unit which is installed on-board of the first carriage and acquiring a second position data of the second carriage via the second SIL4-proved tracking unit which is installed on-board of the second carriage, wherein the first and second position data, are related to a rail route coordinate system and are determined via distance measurement along a rail route coordinate system with reference to at least one reference point on a rail route;

c) determining a deviation between a reference value which depends on the length of the train and a position value which is determined by subtraction of the first and second rail route coordinate system related position data;

d) detecting whether train integrity is given by analyzing the deviation; and e) repeating steps b) through d);

wherein tracking units are part of on-board units of an automatic train protection system.

2. The method according to claim 1, wherein the tracking units are additionally used otherwise than for supervising train integrity.

3. The method according to claim 1, wherein balises are used as reference points.

4. The method according to claim 1, wherein first and second position data are transmitted to a control center of the automatic train protection system, in particular to a radio block center of an ETCS-system, wherein the analyzing of the deviation is carried out by means of a central processing unit of the control center.

5. The method according to claim 1, wherein the position data of the first carriage is transmitted to an on-board unit of the second carriage wherein the analyzing of the deviation is carried out by means of the on-board unit of the second carriage and/or that the position data of the second carriage is transmitted to the first carriage, wherein the analyzing of the deviation is carried out by means of the on-board unit of the first carriage.

6. The method according to claim 1, wherein the first carriage is the front carriage, in particular a locomotive, and the second carriage is the rear carriage, in particular a second locomotive, of the train.

7. The method according to claim 1, wherein an alert is initiated in case analyzing of the deviation result is a loss of train integrity.

8. The method according to claim 1, wherein movement authority is denied in case analyzing of the deviation result is a loss of train integrity.

9. The method according to claim 1, wherein the reference value the position value previously determined by having carried out steps b)-d).

* * * * *